US008746340B2

(12) United States Patent
Mashburn et al.

(10) Patent No.: US 8,746,340 B2
(45) Date of Patent: Jun. 10, 2014

(54) FISH-THRU SCREEN APPARATUS AND METHOD

(75) Inventors: Benny Donald Mashburn, Lafayette, LA (US); Douglas A. Beynon, Youngsville, LA (US)

(73) Assignee: Benny Donald Mashburn, Lafayette, LA (US)

( * ) Notice: Subject to any disclaimer, the term of this patent is extended or adjusted under 35 U.S.C. 154(b) by 648 days.

(21) Appl. No.: 12/985,697

(22) Filed: Jan. 6, 2011

(65) Prior Publication Data

US 2012/0175111 A1 Jul. 12, 2012

(51) Int. Cl.
*E21B 23/00* (2006.01)
*E21B 43/08* (2006.01)

(52) U.S. Cl.
USPC ..... 166/301; 166/205; 166/227; 175/314

(58) Field of Classification Search
USPC ..... 166/301, 205, 227, 229; 175/314
See application file for complete search history.

(56) References Cited

U.S. PATENT DOCUMENTS

| | | | | |
|---|---|---|---|---|
| 405,199 | A * | 6/1889 | Chapman | 175/235 |
| 3,515,210 | A * | 6/1970 | Perkins | 166/205 |
| 4,662,450 | A | 5/1987 | Haugen | |
| 4,856,582 | A | 8/1989 | Smith et al. | |
| 4,857,175 | A | 8/1989 | Spinnier | |
| 5,617,919 | A | 4/1997 | Saucier | |
| 6,598,685 | B1 | 7/2003 | Mashburn | |
| 7,243,742 | B2 * | 7/2007 | Kutryk | 175/314 |
| 7,270,181 | B2 * | 9/2007 | Pluchek et al. | 166/285 |
| 7,549,486 | B2 | 6/2009 | Mashburn et al. | |
| 7,836,948 | B2 | 11/2010 | Kusko | |
| 2005/0121233 | A1 | 6/2005 | Frith | |
| 2006/0213667 | A1 * | 9/2006 | Mashburn et al. | 166/380 |
| 2011/0024119 | A1 * | 2/2011 | Wolf et al. | 166/301 |

OTHER PUBLICATIONS

International Search Report from corresponding International Patent Application No. PCT/US12/20080.
Written Opinion from corresponding International Patent Application No. PCT/US12/20080.

* cited by examiner

*Primary Examiner* — Shane Bomar
*Assistant Examiner* — Robert E Fuller
(74) *Attorney, Agent, or Firm* — Jones Walker LLP

(57) ABSTRACT

A down hole apparatus for filtering debris from a fluid in a well bore including a screen sub, a diverter assembly connected to the screen sub, a screen section extending from the diverter assembly and connected to the screen sub. The screen section includes a plurality of openings for filtering debris from the fluid. The debris collects in an annulus between the screen section and the screen sub. The diverter assembly includes a detachable plug having a fishing portion capable of engaging a fishing tool. Removal of the detachable plug with a fishing tool opens a central passage through the diverter assembly and the screen section. The diverter assembly may include an outer and an inner body and one or more passages between the outer and inner bodies. The detachable plug may include one or more dog members capable of engaging the inner body.

22 Claims, 5 Drawing Sheets

FISH-THRU SCREEN APPARATUS AND METHOD

BACKGROUND OF THE INVENTION

During the process of drilling oil and gas wells, drill bit cuttings are produced by the drill bit as it bores the well bore. The well bore fluid or mud carries the cuttings to the well surface. Some of the cuttings are separated at the surface, but some remain in the mud, which is re-circulated down the work string in the well bore. The mud being re-circulated down hole may also pick up scale from the work string. Debris entrained within the mud is problematic. The debris can cause bottom-hole assemblies such as drill bits, drill motors, measurement while drilling tools, and other components to malfunction. Down hole mud screens have been developed to filter the mud before the fluid is introduced to the bottom-hole assemblies.

Applicant's U.S. Pat. No. 7,549,486 (which is incorporated herein by reference) is titled "Screen Apparatus and Method." The patent discloses a mud screen having either a uniform outer diameter or a mud screen having two discrete sections, each section having a different outer diameter. The patent discloses a series of longitudinal openings for passage of the filtered fluid through the mud screen to the drill pipe.

Although down hole mud screens reduce the frequency at which bottom-hole assemblies malfunction, bottom-hole assemblies must still be removed from time to time. For example, the bottom-hole assembly may require repair or maintenance. Also, the need for certain bottom-hole assemblies may end before the drilling of the well bore is complete. To facilitate the removal of bottom-hole assemblies positioned below mud screens, conventional down hole mud screens must be removed from the well bore. This additional step of removing the entire down hole mud screen is time consuming and expensive, especially when the removal of the mud screen is not necessary for any other purpose. There is a need for a device that can be used to effectively filter debris from a well bore and that can facilitate the removal of a bottom-hole assembly positioned below the device while the device remains in the well bore.

SUMMARY OF THE INVENTION

A down hole apparatus for filtering debris from a debris-containing fluid in a well bore is disclosed. The apparatus includes a screen sub, a diverter assembly operatively connected to the screen sub, and a screen section extending from the diverter assembly. The screen section is also operatively connected to the screen sub. The screen section includes a plurality of openings for filtering debris from the fluid. The diverter assembly includes a detachable plug capable of being detached from the diverter assembly to open a central passage through the diverter assembly and the screen section to permit retrieval of a bottom-hole assembly. The diverter apparatus may also include one or more bypass openings. The central passage through the diverter assembly and the screen section formed by the removal of the detachable plug may be dimensioned to allow passage of a fishing tool therethrough.

The detachable plug may include a fishing portion and one or more dog members. The fishing portion of the detachable plug may be capable of engaging a receiving portion of a fishing tool for removal of the detachable plug from the diverter assembly. The fishing portion of the detachable plug may include a fishing shoulder capable of engaging the receiving portion of the fishing tool.

The diverter assembly may also include an outer body, an inner body disposed within the outer body, and one or more passages between the inner body and the outer body. An o-ring may position the outer body within the screen sub, and the inner body may be dimensioned to receive a portion of the detachable plug. Each of the one or more dog members may include a restricted surface, and the inner body may include a protruding section that is dimensioned to selectively engage the restricted surface of the one or more dog members.

A lower end of the screen section may engage a radial shoulder of the screen sub. Alternatively, the apparatus may further include a base member disposed around a lower end of the screen section, and engaging a radial shoulder of the screen sub. The screen sub may include two or more screen sections, each having a plurality of openings for filtering debris from the fluid. Each of the two or more screen sections may have a different diameter, and the plurality of openings of the two or more screen sections may have differing sizes.

In another embodiment, the down hole apparatus for filtering debris from a debris-containing fluid in a well bore includes a screen sub, a diverter assembly, a screen section, and a base member. The screen sub may include a radial shoulder. The diverter assembly may include an outer body capable of engaging the screen sub, an inner body disposed within the outer body, one or more passages between the inner body and the outer body, and a detachable plug dimensioned to selectively engage the inner body. The screen section extends from the diverter assembly, and includes a plurality of openings for filtering debris from the fluid. The base member is disposed around a lower end of the screen section, and is operatively connected to the radial shoulder of the screen sub. The detachable plug is capable of being detached from the diverter assembly to open a central passage through the diverter assembly and the screen section to permit retrieval of a bottom-hole assembly.

The detachable plug may include a fishing portion and one or more dog members. The dog members may be dimensioned to selectively engage the inner body. Each of the dog members may include a restricted surface dimensioned to selectively engage a protruding surface of the inner body. The fishing portion of the detachable plug may be capable of engaging a receiving portion of a fishing tool for removal of the detachable plug from the diverter assembly. The fishing portion of the detachable plug may include a fishing shoulder capable of engaging the receiving portion of the fishing tool. The inner body of the diverter assembly may include one or more bypass openings.

A method of filtering debris from a debris-containing fluid in a well bore is also disclosed. The method includes providing a filtering apparatus having a screen sub with a radial shoulder, a diverter assembly disposed within the screen sub and having a detachable plug, and a screen section extending from the diverter assembly within the screen sub and operatively connected to the radial shoulder of the screen sub. The screen section includes a plurality of openings. The method also includes deploying the screen sub down the well bore as part of a work string. The method further includes causing the fluid to flow through the work string, the screen sub, the diverter assembly, and the plurality of opening of the screen section, thereby filtering an amount of debris from the fluid. The debris collects in an annulus between the screen section and the screen sub. The method further includes removing the detachable plug from the filtering apparatus thereby opening a central passage through the diverter assembly and the screen section to permit retrieval of a bottom-hole assembly.

The step of removing the detachable plug from the filtering apparatus may include running a fishing tool down the work string to the detachable plug of the diverter assembly, engaging a fishing portion of the detachable plug with a receiving portion of the fishing tool, and removing the detachable plug from the diverter assembly by pulling the fishing tool up through the work string. The fishing tool may be run down the work string with wireline or coiled tubing.

The method of filtering debris from a fluid in a well bore may further include running the fishing tool down the work string, through the screen sub, the diverter assembly, and the screen section to reach the bottom-hole assembly. The bottom-hole assembly may be engaged with the fishing tool, and removed from the well bore by pulling the fishing tool up through the screen section, the diverter assembly, the screen sub, and the work string.

Alternatively, the method of filtering debris from a fluid in a well bore may further include running a second fishing tool down the work string, through the screen sub, the diverter assembly, and the screen section to reach the bottom-hole assembly. The bottom-hole assembly may be engaged with the second fishing tool, and removed from the well bore by pulling the second fishing tool up through the screen section, the diverter assembly, the screen sub, and the work string. The second fishing tool may be run down the work string with wireline or coiled tubing.

The screen sub may be a tubular member including a threaded upper end and a threaded lower end. The step of deploying the screen sub down the well bore may include threadedly connecting the threaded lower end of the screen sub to a lower tubular member and threadedly connecting the upper end of the screen sub to an upper tubular member. A tubular string containing the upper tubular member, the screen sub, and the lower tubular member may then be run down the well bore.

DETAILED DESCRIPTION OF THE PREFERRED EMBODIMENTS

Figure 1A:
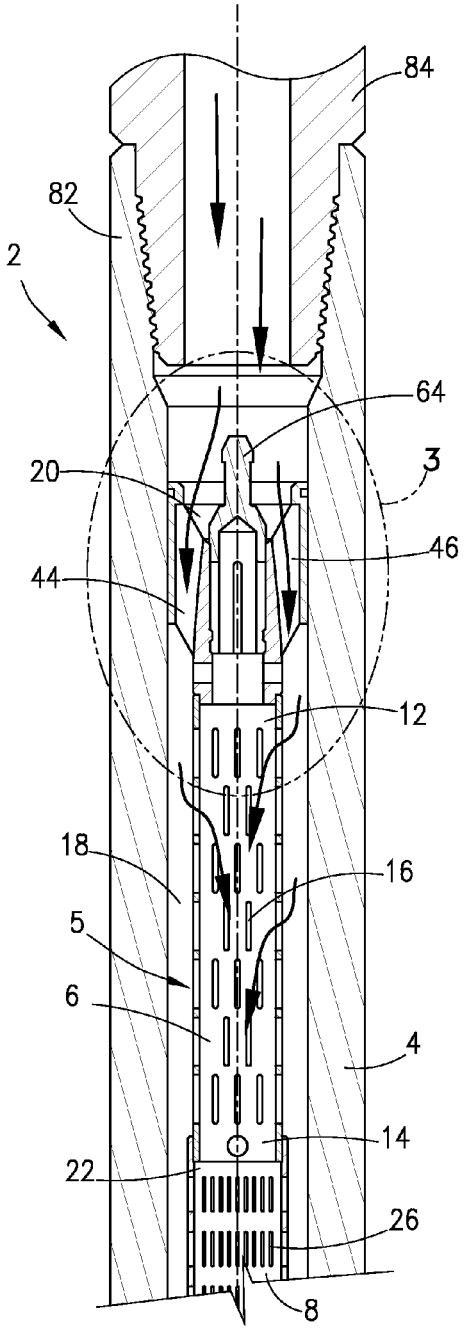
FIGS. 1A and 1B are cross-sectional views of the fish-thru mud screen positioned in a tubular string.
Figure 1B:
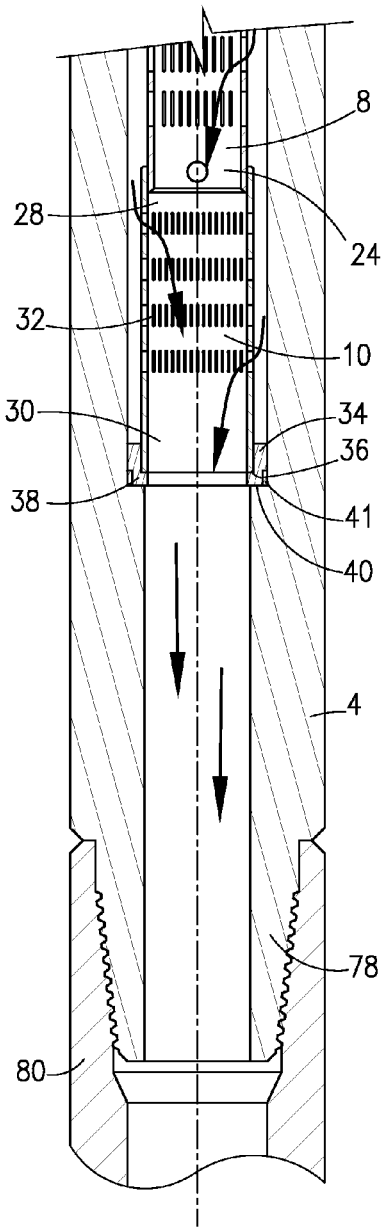

With reference to FIGS. 1A and 1B, fish-thru mud screen 2 may include screen sub 4 having a screen assembly 5 disposed therein. In the embodiment shown in FIGS. 1A and 1B, screen assembly 5 includes three discrete screen sections, namely, first screen section 6, second screen section 8, and third screen section 10. Each section 6, 8, and 10 has a different diameter. In alternate embodiments, screen assembly 5 may have any number of screen sections.

First screen section 6 may include upper end 12, lower end 14, and plurality of openings 16 to allow the separation of debris from drilling mud by allowing only drilling mud to flow from annulus 18 through openings 16 into the internal space (not labeled) of first screen section 6. Upper end 12 of first screen section 6 may be operatively connected to diverter assembly 20. Second screen section 8 may include upper end 22, lower end 24, and plurality of openings 26 for filtering debris from drilling mud. Upper end 22 of second screen section 8 may be operatively connected to lower end 14 of first screen section 6.

Third screen section 10 may include upper end 28, lower end 30, and plurality of openings 32 for filtering debris from drilling mud. Upper end 28 of third screen section 10 may be operatively connected to lower end 24 of second screen section 8. Lower end 30 of third screen section 10 may be operatively connected to base member 34 by abutting radial shoulder 36 such that base member 34 supports third screen section 10. Base member 34 may in turn be operatively connected to screen sub 4 such that lower end 38 of base member 34 abuts radial shoulder 40 of screen sub 4. O-ring 41 may seal the connection between base member 34 and screen sub 4. Radial shoulder 40 of screen sub 4 may support base member 34 and third screen section 10. First screen section 6 may have the smallest diameter and the largest openings 16 of the three screen sections. Third screen section 10 may have the largest diameter and the smallest openings 32 of the three screen sections.

Figure 3:
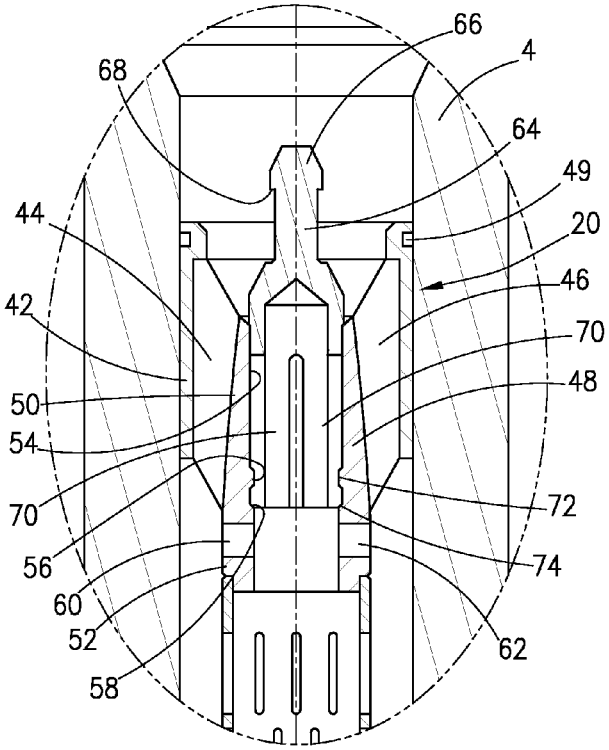
FIG. 3 is a cross-sectional view of the diverter assembly of fish-thru mud screen.

Referring now to FIG. 3, diverter assembly 20 of fish-thru mud screen 2 includes outer body 42, passages 44 and 46 around inner body 48. Outer body 42 may be operatively connected to screen sub 4 with o-ring 49. Inner body 48 includes upper portion 50 and lower portion 52. Upper portion 50 may include inner surface 54 having protruding section 56 and beveled shoulder 58. Lower portion 52 may include bypass openings 60 and 62.

Figure 2A:
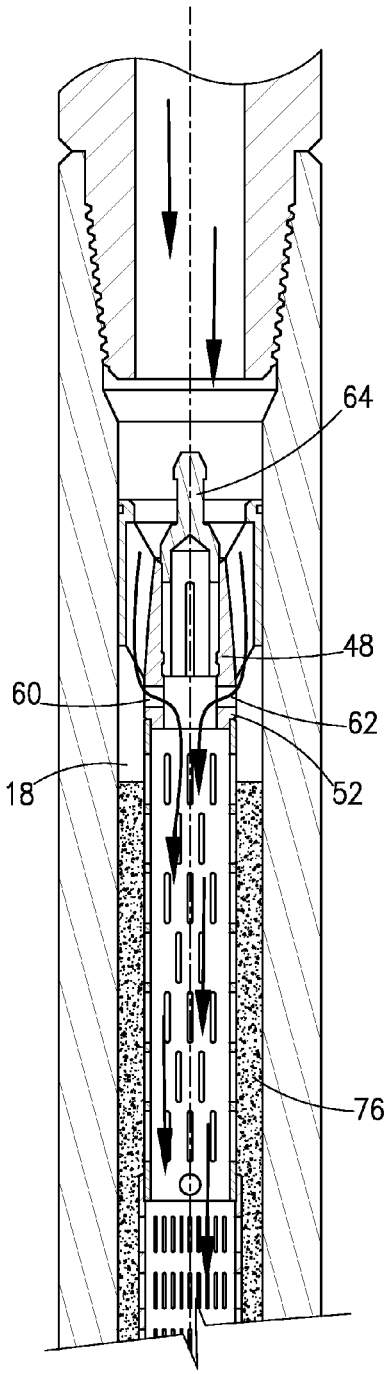
FIGS. 2A and 2B are cross-sectional views of the fish-thru mud screen having debris trapped in the annulus.

Diverter assembly 20 also includes detachable plug 64 which may have fishing portion 66, fishing shoulder 68, and one or more dog members 70. Each dog member 70 may contain restricted surface 72 and beveled end 74. In the engaged position as shown in FIGS. 1A, 2A, and 3, protruding section 56 of inner body 48 engages restricted surface 72 of each dog member 70 thereby securing detachable plug 64 within upper portion 50 of inner body 48. Also, beveled end 74 of each dog member 70 may engage beveled shoulder 58 of inner body 48 thereby preventing detachable plug 64 from moving further into inner body 48.

Returning to FIGS. 1A and 1B, detachable plug 64 is illustrated in the engaged position. In this position, the detachable plug 64 forces drilling mud flowing through screen sub 4 to flow through passages 44 and 46 and into annulus 18. Screen sections 6, 8, and 10 filter drilling mud in annulus 18 by allowing drilling mud to flow through plurality of openings 16, 26, and 32, while preventing debris of certain sizes carried in the drilling mud from passing through openings 16, 26, and 32. Filtered drilling mud flows through inner bores of screen sections 6, 8, and 10 and through screen sub 4 below fish-thru mud screen 2 further into the well bore.

Figure 2B:
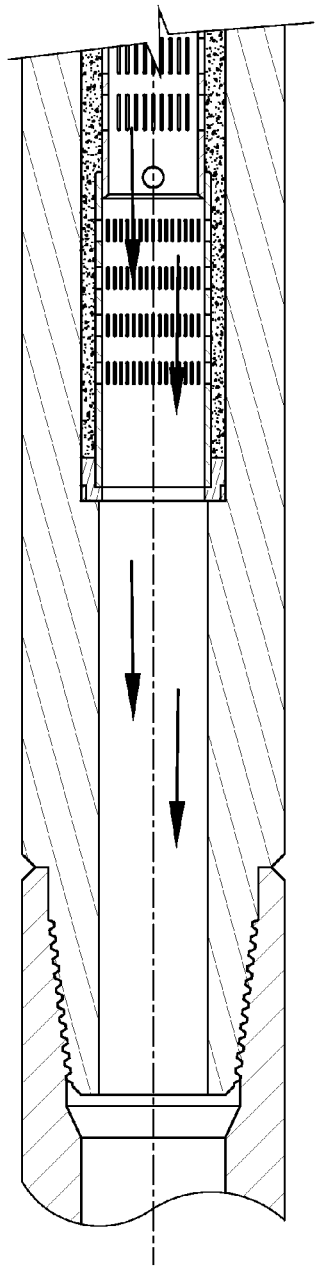

As shown in FIGS. 2A and 2B, debris removed from the drilling fluid collects in annulus 18. When the accumulation of debris 76 blocks openings 16, 26, and 32, the drilling fluid flows through bypass openings 60 and 62 in lower portion 52 of inner body 48. In the engaged position, detachable plug 64 blocks passage of any tools through inner body 48 and screen sections 6, 8, and 10.

With reference to FIGS. 1A-2B, fish-thru mud screen 2 may be deployed down hole as part of a tubular string or work string. As well understood by one skilled in the art, lower threaded end 78 of screen sub 4 may be threadedly connected to lower tubular member 80 on a drilling rig. Then, upper threaded end 82 of screen sub 4 may be threadedly connected to upper tubular member 84. The tubular string containing upper tubular member 84, screen sub 4 with screen assembly 5, and lower tubular member 80 may be run down the well bore while drilling in order to filter drilling mud before the drilling mud reaches any of the bottom-hole assemblies positioned below fish-thru mud screen 2 in the tubular string.

Figure 4:
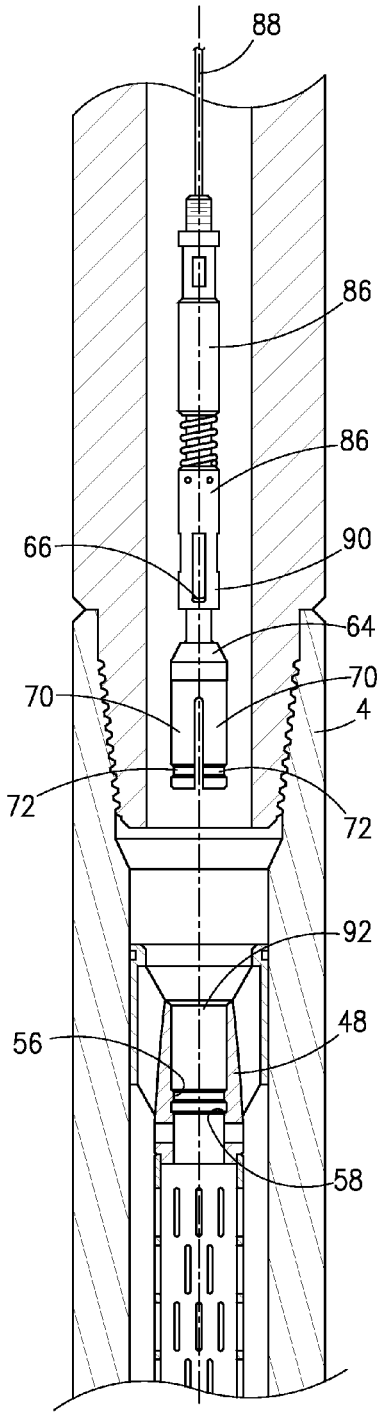
FIG. 4 is a sequential cross-sectional view of FIGS. 1A and 1B showing the detachable plug being removed from the fish-thru mud screen.

Referring now to FIG. 4, fishing tool 86 may be run down the well bore into screen sub 4 with wireline 88 or any other know method (e.g., coiled tubing). Receiving portion 90 of fishing tool 86 may have a shape that is reciprocal to fishing portion 66 of detachable plug 64. Fishing tool 86 may be a JDC-type overshot or any other fishing tool having a receiving portion reciprocal to fishing portion 66 of detachable plug 64. When fishing tool 86 is lowered to the level of detachable plug 64, receiving portion 90 of fishing tool 86 may fit around fishing portion 66 of detachable plug 64, and receiving portion 90 may engage fishing shoulder 68 of detachable plug 64 thereby securing detachable plug 64 to fishing tool 86. Fishing tool 86 may be lifted to remove detachable plug 64 from fish-thru mud screen 2 by disengaging restricted surface 72 of each of dog members 70 of detachable plug 64 from protruding section 56 and beveled shoulder 58 of inner body 48. After removing detachable plug 64, opening 92 may be formed in diverter assembly 20. The size of opening 92 may be sufficient to allow a fishing tool (e.g., fishing tool 86) to be lowered through a central passage in inner body 48, and to access or retrieve bottom-hole assemblies positioned below fish-thru mud screen 2. For example, opening 92 may have a diameter of approximately two inches.

Figure 5A:
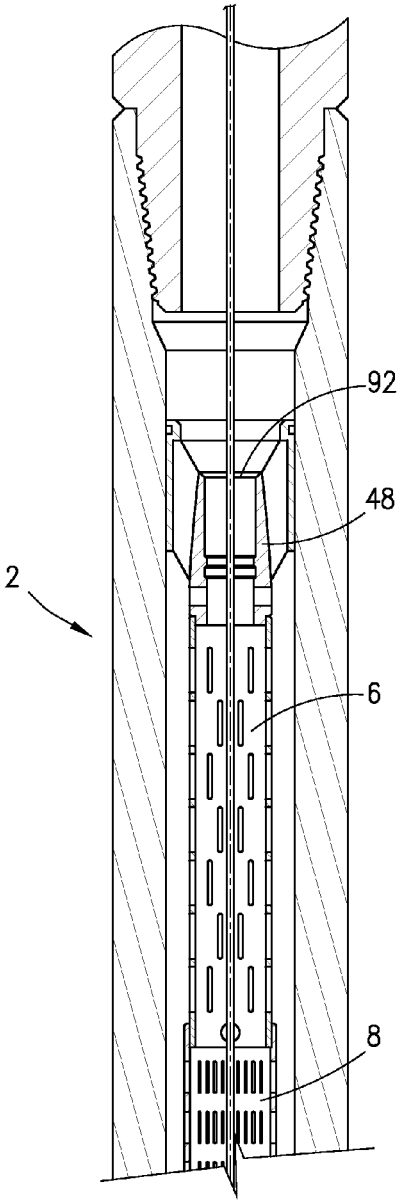
FIGS. 5A and 5B are sequential cross-sectional views of FIG. 4 showing a fishing tool being lowered beyond the fish-thru mud screen into the well bore.
Figure 5B:
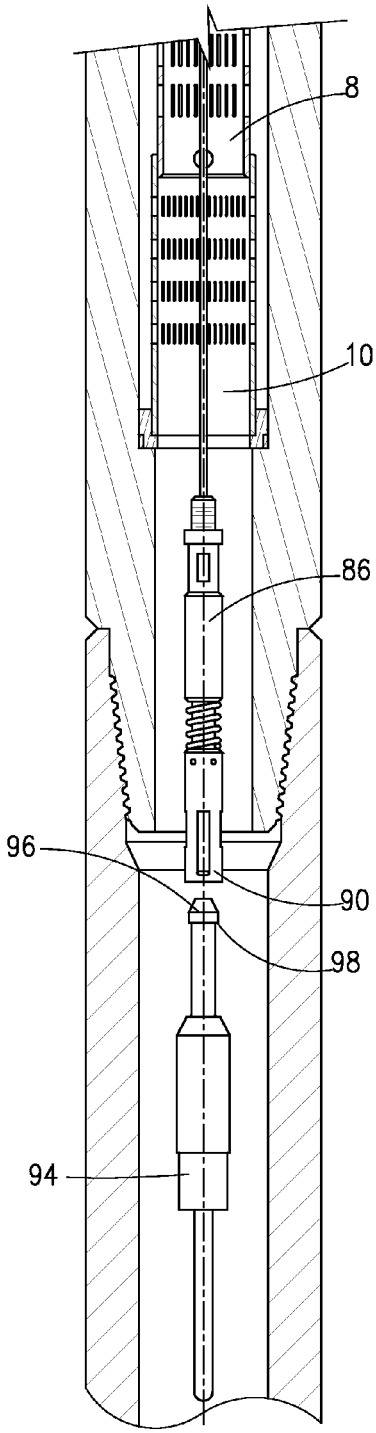

As shown in FIGS. 5A and 5B, fishing tool 86 or another fishing tool may be run down the well bore and through opening 92 in diverter assembly 20, inner body 48, and screen sections 6, 8, and 10 in order to reach bottom-hole assembly 94 disposed below fish-thru mud screen 2 in the well bore. Bottom-hole assembly 94 may have a fishing portion 96 with a fishing shoulder 98. Fishing portion 96 may have a shape that is reciprocal to receiving portion 90 of fishing tool 86.

Figure 6A:
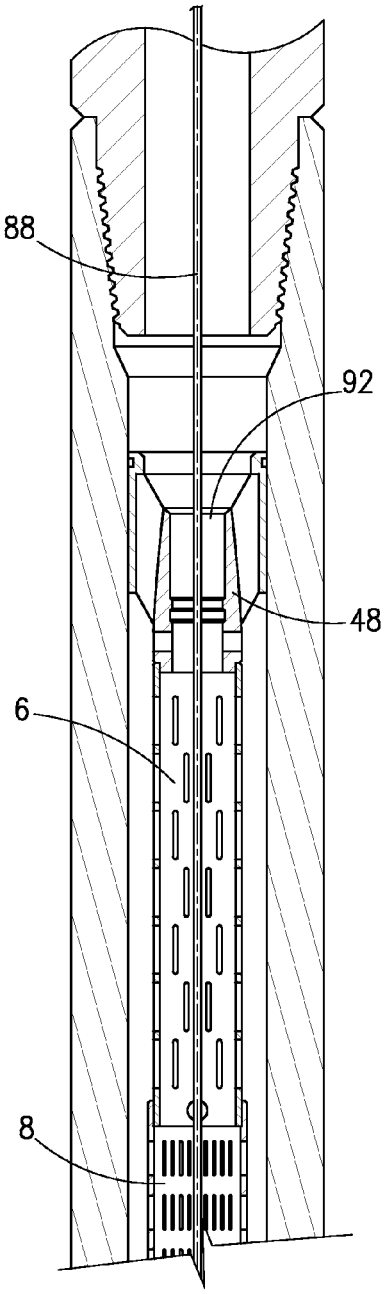
FIGS. 6A and 6B are sequential cross-sectional views of FIGS. 5A and 5B showing the fishing tool removing a down hole assembly through the fish-thru mud screen.
Figure 6B:
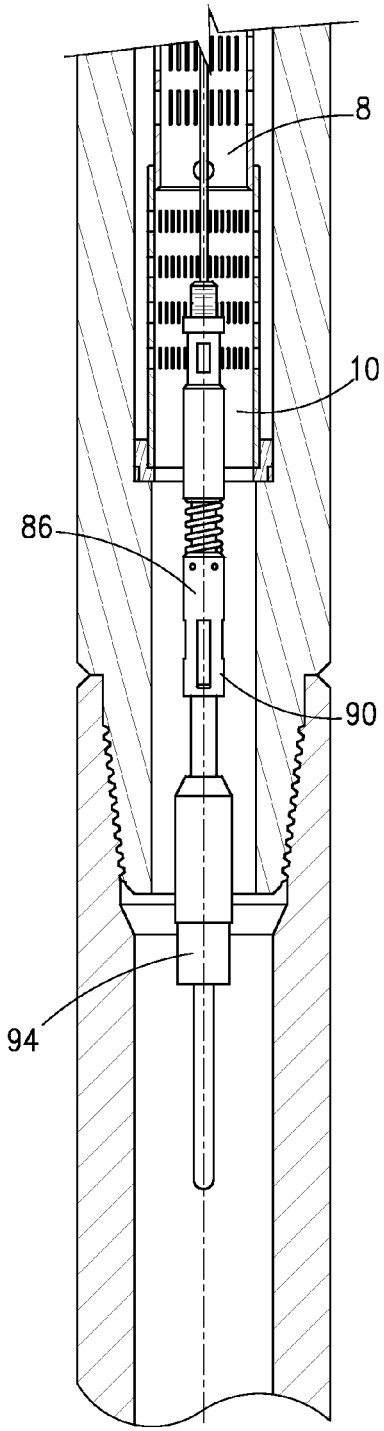

With reference to FIGS. 6A and 6B, receiving portion 90 of fishing tool 86 may fit around fishing portion 96 of bottom-hole assembly 94, and receiving portion 90 may engage fishing shoulder 98 of bottom-hole assembly 94 thereby securing bottom-hole assembly 94 to fishing tool 86. Fishing tool 86 may be lifted through screen sections 6, 8, and 10, inner body 48, and opening 92 of fish-thru mud screen 2 to remove bottom-hole assembly 94 from the well bore for repairs or maintenance.

After removing bottom-hole assembly 94, detachable plug 64 may again be attached to fishing tool 86 by engaging fishing portion 66 of detachable plug 64 with receiving portion 90 of fishing tool 86. Fishing tool 86 and attached detachable plug 64 may be lowered into the tubular string by wireline 88 or any other known method (e.g., by coiled tubing). Upon reaching diverter assembly 20, the one or more dog members 70 of detachable plug 64 may again engage inner body 48.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A down hole apparatus for filtering debris from a debris-containing fluid in a well bore, the apparatus comprising:

a screen sub;

a diverter assembly operatively connected to said screen sub, said diverter assembly comprising an outer body capable of engaging said screen sub, an inner body disposed within said outer body, a detachable plug dimensioned to selectively engage said inner body, one or more passages between an outer surface of said inner body and an inner surface of said outer body, and one or more bypass openings, wherein said detachable plug comprises a fishing portion and one or more dog members dimensioned to selectively engage said inner body; and a screen section extending from said diverter assembly and operatively connected to said screen sub, said screen section comprising a plurality of openings for filtering debris from said fluid;

wherein said detachable plug is capable of being detached from said diverter assembly to open a central passage through said diverter assembly and said screen section to permit retrieval of a bottom-hole assembly through said central passage.

2. The down hole apparatus of claim 1, wherein said central passage is dimensioned to allow passage of a fishing tool therethrough.

3. The down hole apparatus of claim 1, wherein said fishing portion of said detachable plug is capable of engaging a receiving portion of a fishing tool for removal of said detachable plug from said diverter assembly.

4. The down hole apparatus of claim 3, wherein said fishing portion of said detachable plug comprises a fishing shoulder capable of engaging said receiving portion of said fishing tool.

5. The down hole apparatus of claim 3, further comprising an o-ring for positioning said outer body within said screen sub.

6. The down hole apparatus of claim 3, wherein said inner body is dimensioned to receive said one or more dog members of said detachable plug.

7. The down hole apparatus of claim 6, wherein each of said one or more dog members comprises a restricted surface, and wherein said inner body comprises a protruding section dimensioned to selectively engage said restricted surface of said one or more dog members.

8. The down hole apparatus of claim 1, wherein a lower end of said screen section engages a radial shoulder of said screen sub.

9. The down hole apparatus of claim 1, further comprising a base member disposed around a lower end of said screen section, said base member engaging a radial shoulder of said screen sub.

10. The down hole apparatus of claim 1, wherein said screen section comprises two or more screen sections each comprising a plurality of openings for filtering debris from said fluid, wherein each of said two or more screen sections has a different diameter, and wherein said plurality of openings of said two or more screen sections have differing sizes.

11. A down hole apparatus for filtering debris from a debris-containing fluid in a well bore, the apparatus comprising:

a screen sub comprising a radial shoulder;

a diverter assembly comprising an outer body capable of engaging said screen sub, an inner body disposed within said outer body, a detachable plug dimensioned to selectively engage said inner body, and one or more passages between said inner body and said outer body, wherein said detachable plug comprises a fishing portion and one or more dog members dimensioned to selectively engage said inner body;

a screen section extending from said diverter assembly, said screen section comprising a plurality of openings for filtering debris from said fluid; and a base member disposed around a lower end of said screen section, said base member engaging said radial shoulder of said screen sub;

wherein said detachable plug is capable of being detached from said diverter assembly to open a central passage through said diverter assembly and said screen section to permit retrieval of a bottom-hole assembly through said central passage.

12. The down hole apparatus of claim 11, wherein each of said one or more dog members comprises a restricted surface dimensioned to selectively engage a protruding section of said inner body.

13. The down hole apparatus of claim 12, wherein said fishing portion of said detachable plug is capable of engaging a receiving portion of a fishing tool for removal of said detachable plug from said diverter assembly.

14. The down hole apparatus of claim 13, wherein said fishing portion of said detachable plug comprises a fishing shoulder capable of engaging said receiving portion of said fishing tool.

15. The down hole apparatus of claim 13, wherein said inner body of said diverter assembly comprises one or more bypass openings.

16. A method of filtering debris from a debris-containing fluid in a well bore, comprising the steps of:

(a) providing a filtering apparatus comprising: a screen sub comprising a radial shoulder; a diverter assembly disposed within said screen sub and comprising an outer body capable of engaging said screen sub, an inner body disposed within said outer body, a detachable plug dimensioned to selectively engage said inner body, and one or more passages between an outer surface of said inner body and an inner surface of said outer body, wherein said detachable plug comprises a fishing portion and one or more dog members dimensioned to selectively engage said inner body; and a screen section extending from said diverter assembly within said screen sub and operatively connected to said radial shoulder of said screen sub, said screen section comprising a plurality of openings;

(b) deploying said screen sub down the well bore as part of a work string;

(c) causing said fluid to flow through said work string, said screen sub, said diverter assembly, and said plurality of openings of said screen section, thereby filtering an amount of debris from said fluid, said debris collecting in an annulus between said screen section and said screen sub; and (d) removing said detachable plug from said filtering apparatus thereby opening a central passage through said diverter assembly and said screen section to permit retrieval of a bottom-hole assembly through said central passage.

17. The method of claim 16, wherein step (d) further comprises the steps of:

(i) running a fishing tool down the work string to said detachable plug of said diverter assembly;

(ii) engaging the fishing portion of said detachable plug with a receiving portion of said fishing tool; and (iii) removing said detachable plug from said diverter assembly by pulling said fishing tool up through said work string.

18. The method of claim 17, wherein said fishing tool is run down the work string with wireline or coiled tubing.

19. The method of claim 17, further comprising the steps of:

(e) running said fishing tool down the work string, through said screen sub, said diverter assembly, and said screen section to reach said bottom-hole assembly;

(f) engaging said bottom-hole assembly with said fishing tool; and (g) removing said bottom-hole assembly from the well bore by pulling said fishing tool up through said screen section, said diverter assembly, said screen sub, and said work string.

20. The method of claim 17, further comprising the steps of:

(e) running a second fishing tool down the work string, through said screen sub, said diverter assembly, and said screen section to reach said bottom-hole assembly;

(f) engaging said bottom-hole assembly with said second fishing tool; and (g) removing said bottom-hole assembly from the well bore by pulling said second fishing tool up through said screen section, said diverter assembly, said screen sub, and said work string.

21. The method of claim 20, wherein said second fishing tool is run down the work string with wireline or coiled tubing.

22. The method of claim 16, wherein said screen sub is a tubular member comprising a threaded upper end and a threaded lower end, and wherein step (b) further comprises the steps of:

(i) threadedly connecting said threaded lower end of said screen sub to a lower tubular member and threadedly connecting said threaded upper end of said screen sub to an upper tubular member; and (ii) running a tubular string comprising said upper tubular member, said screen sub, and said lower tubular member down the well bore.

* * * * *